US008261386B2

(12) United States Patent
Kardos

(10) Patent No.: US 8,261,386 B2
(45) Date of Patent: Sep. 11, 2012

(54) BACK SUPPORT

(75) Inventor: Laura Anne Kardos, Grosse Ile, MI (US)

(73) Assignee: Mom's Essentials, LLC, Grosse Ile, MI (US)

( * ) Notice: Subject to any disclaimer, the term of this patent is extended or adjusted under 35 U.S.C. 154(b) by 0 days.

(21) Appl. No.: 13/315,653

(22) Filed: Dec. 9, 2011

(65) Prior Publication Data

US 2012/0186025 A1 Jul. 26, 2012

Related U.S. Application Data

(60) Provisional application No. 61/461,966, filed on Jan. 26, 2011.

(51) Int. Cl.
*A47C 7/02* (2006.01)
*A47C 7/18* (2006.01)

(52) U.S. Cl. ..... 5/655.9; 5/633; 5/639; 297/452.32; 297/452.37

(58) Field of Classification Search ..... 5/655.9, 5/657, 652, 633, 632, 639, 490; 297/183.1, 297/230.1, 452.26, 452.27, 452.29, 452.3, 297/452.32, 452.35, 452.37
See application file for complete search history.

(56) References Cited

U.S. PATENT DOCUMENTS

| | | | | | |
|---|---|---|---|---|---|
| 2,970,638 | A | * | 2/1961 | Halter | 297/452.25 |
| 4,277,859 | A | * | 7/1981 | Seaman | 5/639 |
| 4,506,929 | A | * | 3/1985 | Josefek | 297/230.13 |
| 4,535,495 | A | | 8/1985 | Oldfield | |
| 4,572,578 | A | * | 2/1986 | Perkins | 297/452.32 |
| 4,753,482 | A | * | 6/1988 | Warren | 297/452.26 |
| 4,783,120 | A | * | 11/1988 | Kiechlin | 297/183.1 |
| 4,835,801 | A | | 6/1989 | Walpin et al. | |
| 5,423,098 | A | | 6/1995 | Swezey et al. | |
| D375,222 | S | | 11/1996 | Bonaddio et al. | |
| D427,833 | S | | 7/2000 | Robinson | |
| 6,154,904 | A | * | 12/2000 | Ehredt | 5/639 |

* cited by examiner

*Primary Examiner* — Robert G Santos
(74) *Attorney, Agent, or Firm* — Druan IP Law, PLLC

(57) ABSTRACT

A back support that provides lumbar support, mid-back support, lateral back support, and arm supports to compensate for a lack of strength in one's core muscles, such as after pregnancy or abdominal surgery. The arm supports are shaped to provide a surface to resist downward force of one's arms while allowing the arms to stay close to the body, as when holding or feeding a baby. The back support encourages proper spinal alignment by providing appropriate areas of support, including a protrusion on the top of the back support that serves as a physical cue to a user when their body is fully upright and centered.

5 Claims, 4 Drawing Sheets

BACK SUPPORT

CROSS REFERENCE TO RELATED APPLICATION

This application claims priority to Provisional Patent Application No. 61/461,966, filed Jan. 26, 2011, which is hereby incorporated by reference for all purposes.

FIELD OF THE INVENTION

The present invention relates generally to back supports, and more particularly to back supports configured to assist post-partum nursing.

BACKGROUND

The benefit of lumbar pillows for encouraging proper posture while seated is relatively well known. One type of lumbar support that is currently available is a separate cushion that can be used when seated. This type of lumbar support is relatively small, typically not extending beyond the lumbar region of the spine. Lumbar supports are also built into seating such as car seats and office chairs, but generally have very small protrusions or shallow curvature.

While these lumbar supports can provide a certain level of support, they do not adequately support those with weakened cores or exaggerated spinal curvature seen especially in women who are either pregnant or who have recently given birth. During pregnancy, a woman's spine undergoes significant biomechanical changes in order to prepare for delivery. As a woman's center of gravity moves forward her pelvis tilts forward, increasing the curvature of the spine at the lower (lumbosacral) area, generally referred to as lordotic curvature. As this happens, the upper (thoracic) spine compensates by increasing its curvature, generally known as kyphodic curvature.

In addition to spinal changes in response to a shifting center of gravity, the spine is also affected by the release of a hormone relaxin that allows joints and ligaments to soften and stretch in order to aid in delivery. This affects the spine by softening the outer fibers of the intervertebral discs, reducing the rigidity of the spine and further increasing its curvature. This relaxation of the spine then relies on the supporting muscles and ligaments of the core for stability. During this time, however, the abdominal muscles are being stretched forward and cannot provide much structural support, leaving the majority of the compensation up to the muscles of the back. This generally causes tightness and discomfort as the pregnancy progresses, and continues for months after delivery as the abdominal muscles and relaxin levels return to normal. The lack of core strength is even more pronounced after a Caesarian section where the abdominal muscles have been cut.

Because of the increased curvature of the spine and decreased core strength, the weight of the upper body, especially while holding a baby during nursing, is quite difficult to counteract using primarily lower back muscles. A typical lumbar support is not very effective at providing proper support for this situation as abdominal muscles are not strong enough to cause the lumbar spine to engage the lumbar support, and the weight of the upper body, especially when holding a baby, is not significantly relieved by the structure of the lumbar support.

Other back supports on the market also fall short. For example, a back support having arms that is generally used in bed or on the floor exists that allows a user to rest their arms on the arms of the support. These devices are generally plush pillows providing a comfortable seating position, but offer little or no actual support for the spine. Pushing against the arm supports with one's elbows will generally cause the pillow to deform instead of providing a bearing surface to adjust one's posture. Even if posture is able to be adjusted slightly, the plush backing does not encourage proper spinal curvature. Some cushions such as this may add a stiff frame of some sort to provide more structure, but are often large and cumbersome to move around, and which also are too flimsy to be load-bearing.

SUMMARY

In view of the foregoing, a back support that provides lumbar support and encourages proper spinal curvature and alignment for user's having weakened core muscles is desired. The present invention, in one embodiment, provides a back support having a rear cushion with a top surface, bottom surface and front surface; a protrusion extending from the top surface of the rear cushion; a lumbar cushion disposed on the front surface of the rear cushion, the lumbar cushion having a central convexity shaped to fit the lumbar curve of a user's spine and lateral wings extending forward of the central convexity that wrap around the sides of a user's lower back; and two arms rests, one on each side of the lumbar cushion, each arm rest having a generally upward-facing surface extending forward of the lateral wings of the lumbar cushion, and against which a user can press their arms. In some embodiments, the back support is made of dense foam. The back support can also be made of materials of multiple densities. In some embodiments, the back support has a cover encapsulating the rear cushion, protrusion, lumbar cushion, and arm rests.

BRIEF DESCRIPTION OF THE FIGURES

The accompanying figures, which together with the detailed description below are incorporated in and form part of the specification, serve to further illustrate various embodiments and to explain various principles and advantages all in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

The invention is directed to a back support to help those with weakened core muscles to properly align their spine. The invention is particularly helpful for pregnant or recently post-partum women whose spines and core muscles undergo significant changes. The strain on these women's backs increases when having to hold or nurse a child under these conditions.

For the average person, holding something in the arms requires strength in both the arms and the core since the weight is typically held in front of the body. Because the abdominal wall of a pregnant woman has been stretched, the muscular support system in the abdomen is compromised and may not adequately support the upper body or any additional weight. Therefore, in order to help compensate for decreased core strength, a back support offering a bearing surface for one's arms is provided.

Figure 1:
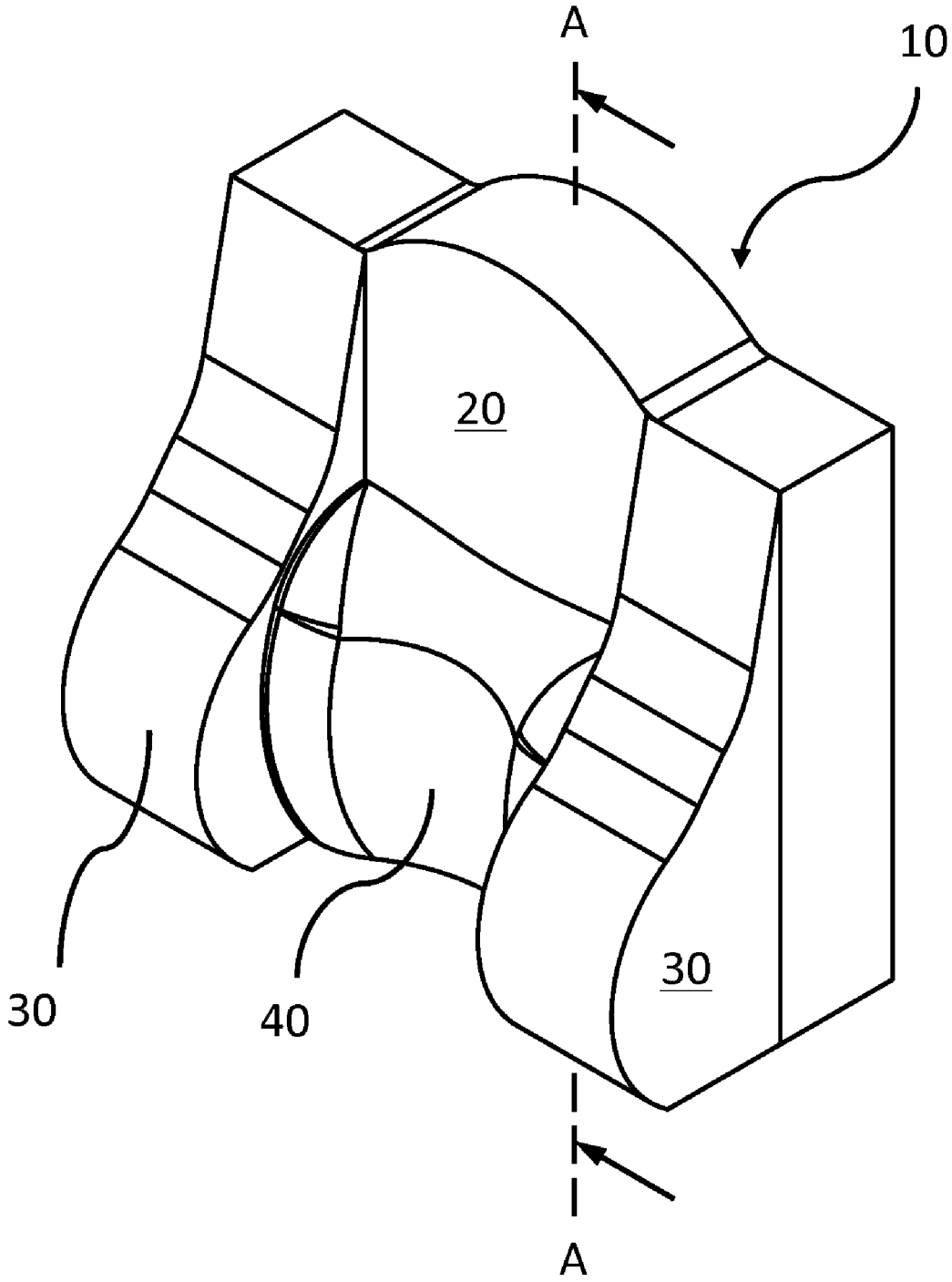
FIG. 1 is an isometric view of an embodiment of the present invention.

FIG. 1 shows one embodiment of a back support 10 according the present invention. Back support 10 has a base support 20, arm supports 30, and lumbar support 40.

Figure 2:
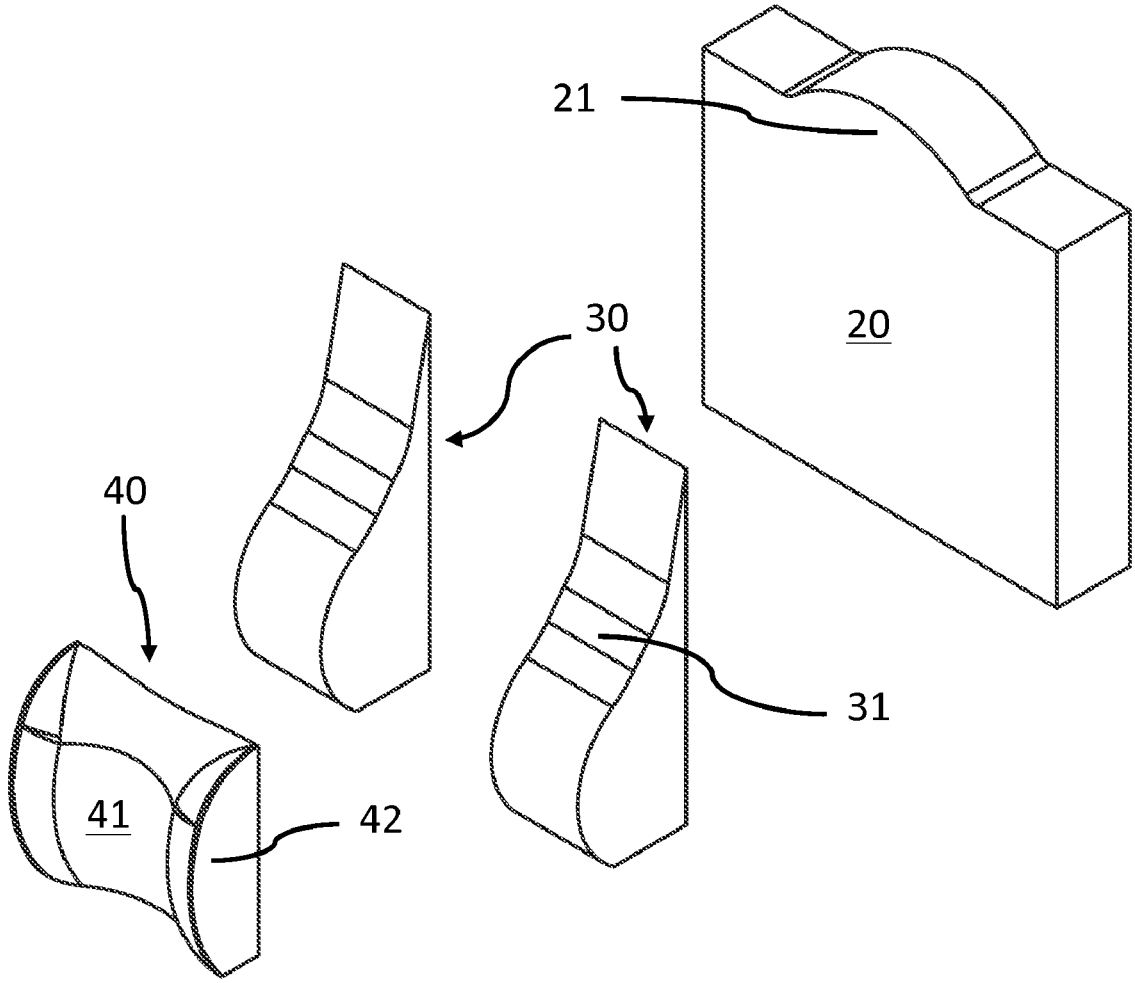
FIG. 2 is an exploded view of the embodiment of FIG. 1.

FIG. 2 shows an exploded view of the embodiment of FIG. 1. Base support 20 has protrusion 21 extending from an upper surface thereof. Arm supports 30 have upper surface 31 against which arms can be pressed to raise a user's torso using arm muscles in addition to the usual back and abdominal muscles, which may be weakened during pregnancy. Lumbar support 40 has a generally outward protruding lumbar cushion 41 that engages the lumbar region of a users spine, and lateral supports 42 that wrap around the loin area of a user. Lumbar support 40 can be comprised of separate lumbar cushion 41 and lateral supports 42, and need not be a unitary piece as shown.

While FIG. 2 shows the back support 10 as being composed of four main pieces (a rear support, two arm supports and a lumbar support), it is contemplated that the back support may be comprised of more or fewer than four pieces, including a back support made of a unitary piece of material. In one embodiment, the back support 10 is made out of dense foam; however, the back support 10 can also be constructed of multiple types of materials having different densities, such as layers of fiberfill, plastics, woods, metals, or any other material or combination of materials that can provide adequate spinal support while still being comfortable to use. While the embodiments of back support 10 shown in FIGS. 1-3 have sharp edges, chamfered or rounded edges are also contemplated for comfort and aesthetics.

Figure 3:
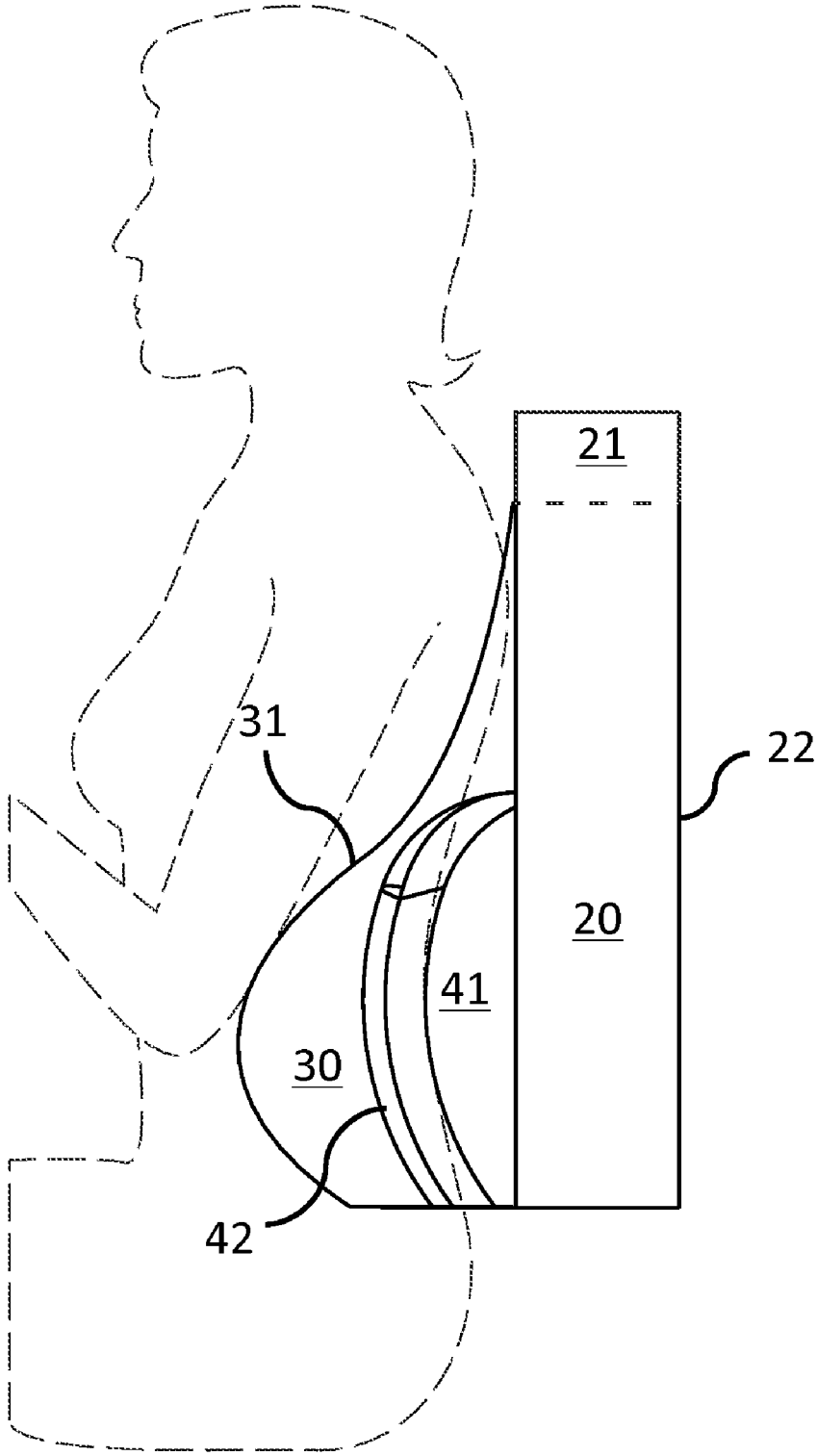
FIG. 3 is a cross-sectional view of the embodiment of FIG. 1 taken along line A-A.

FIG. 3 shows a user (in ghost) with the back support 10 positioned with the lumbar cushion 41 engaging the lumbar region of the user's spine. In this position, the user's arms can engage the upper surface 31 of the arm supports 30, pushing the shoulders up and back against the base support 20. Protrusion 21 is positioned to provide proprioception, or positional feedback, to the user when the spine is in a fully upright position. In addition to helping straighten the thoracic spine, utilizing arm supports 30 takes stress off the lumbar spine, allowing it to more easily engage the lumbar support 40. This is especially helpful while the user is nursing or otherwise holding a child in her arms.

As seen in FIG. 3, base support 20 has a rear surface 22 that is pressed against a surface such as a wall or chair-back so that the back support 10 can press against a user's back. When a user exerts pressure against an upper surface 31 of arm support 30 to extend the user's upper spine rearward, the rear surface 22 provides frictional static force in the vertical direction to oppose the force of the arms pressing against an upper surface 31. Pressure exerted perpendicular to surfaces 31 has a horizontal component that pushes the rear surface 22 against the wall or other supporting surface, and a vertical component that acts to push the upper body upwards.

Figure 4:
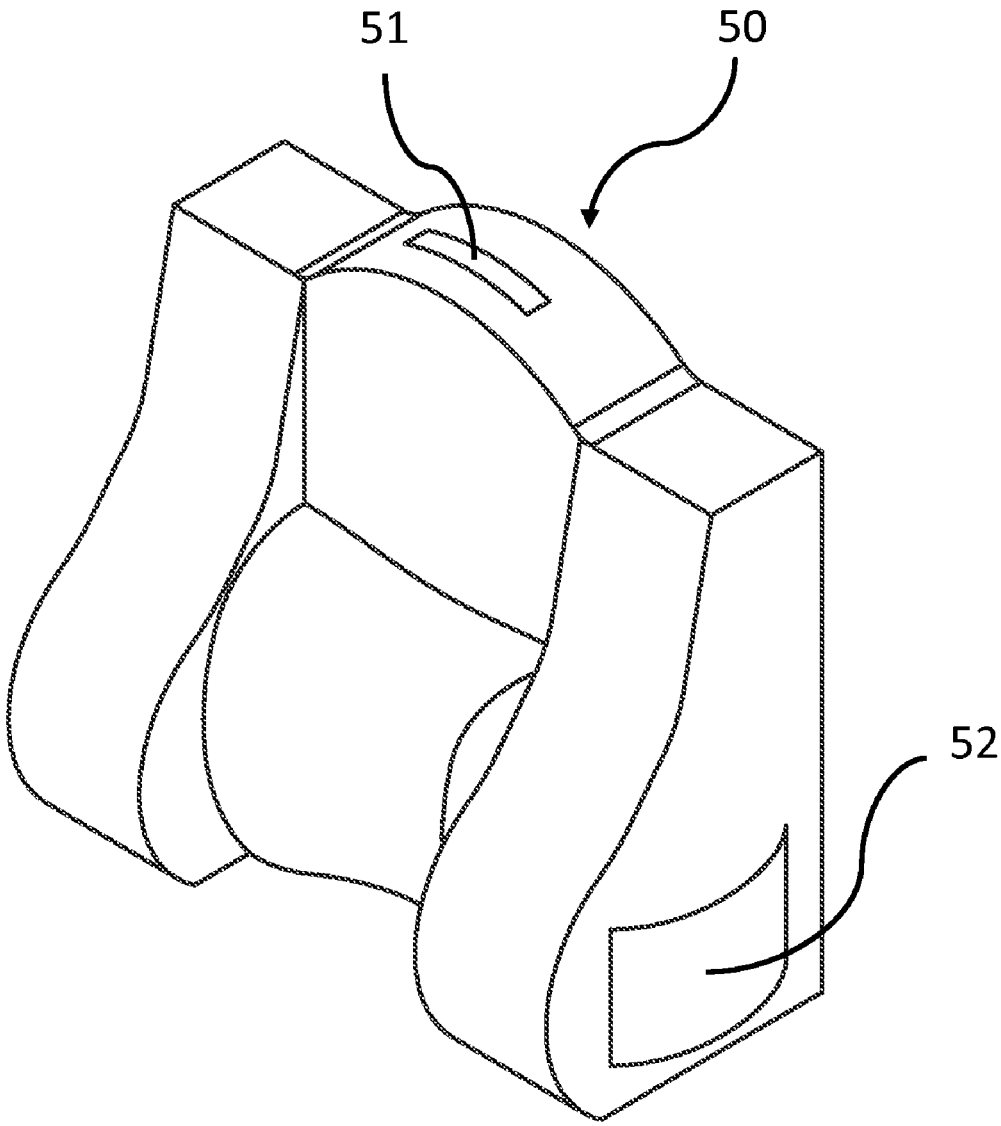
FIG. 4 is an isometric view of a cover according to an embodiment of the present invention.

FIG. 4 shows cover 50 provided in some embodiments. Cover 50 encapsulates the base support 20, arm supports 30, and lumbar support 40. In some embodiments, cover 50 has a handle 51 near the top of the back support 10 to help move and maneuver the back support with one hand. In some embodiments, cover 50 can have therein side pockets 52 to hold various items such as bottles, books, phones, etc.

Regarding the size of back support 10, it is contemplated that the arm supports 30 are positioned relatively close to one's torso, and have an inner edge that lies within shoulder-width of the user so that elbows can be rested on the upper surfaces 31 of arm supports 30 while staying relatively close to the user's body, allowing for a natural nursing position than would be provided using the relatively wide-set arms of a typical nursing chair. Also, the outer dimensions of back support 10 should be narrow enough to accommodate use in a typical armed chair such as a rocking or nursing chair. This sizing allows the device to be used in most chairs while also being small and light enough for a user to easily move and maneuver, preferably with one hand.

While the invention has been discussed primarily in the context of pregnant or post-partum women having weakened core muscles, this invention is also useful in relieving general back pain. The ability of a user to press down on arm supports 30 to relieve spinal pressure and encourage proper posture can be used by anyone looking to relieve or avoid back pain.

In the foregoing specification, specific embodiments of the present invention have been described. However, one of ordinary skill in the art appreciates that various modifications and changes can be made without departing from the scope of the present invention as set forth in the claims below.

Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A back support comprising:

a rear cushion having a top surface, bottom surface and front surface; a protrusion extending from the top surface of the rear cushion;

a lumbar cushion disposed on the front surface of the rear cushion, the lumbar cushion having a central convexity shaped to fit the lumbar curve of a user's spine and lateral wings extending forward of the central convexity that wrap around the sides of a user's lower back; and two arm rests, one on each side of the lumbar cushion, each arm rest having a generally upward-facing surface extending forward of the lateral wings of the lumbar cushion, and against which a user can press their arms.

2. The back support of claim 1, wherein the back support is made of dense foam.

3. The back support of claim 1, wherein the back support is made of materials of multiple densities.

4. The back support of claim 1, further comprising a cover encapsulating the rear cushion, protrusion, lumbar cushion, and arm rests.

5. The back support of claim 4, wherein the cover has a handle adjacent the top of the back support, and pockets along the arm rests of the back support.

* * * * *